United States Patent [19]

Judkins et al.

[11] Patent Number: 4,701,213

[45] Date of Patent: Oct. 20, 1987

[54] REDUCTION OF IRON ORE CONCENTRATES WITH MAGNESIUM OR ALUMINUM

[76] Inventors: Kenneth R. Judkins, 17 Floyd Cir.; Michael D. Osmundson, 38 Field Rd., both of Silver Bay, Minn. 55614

[21] Appl. No.: 813,405

[22] Filed: Dec. 26, 1985

[51] Int. Cl.[4] ..... C21B 15/02

[52] U.S. Cl. ..... 75/27; 75/40

[58] Field of Search ..... 75/27, 40

[56] References Cited

U.S. PATENT DOCUMENTS

| | | | |
|---|---|---|---|
| 778,345 | 12/1904 | Weber . | |
| 802,941 | 10/1905 | Rossi . | |
| 1,277,034 | 8/1918 | Boericke . | |
| 1,277,035 | 8/1918 | Boericke . | |
| 1,751,550 | 3/1930 | Hyde . | |
| 2,471,562 | 5/1949 | Fitterer | 75/27 |
| 3,503,736 | 3/1970 | Sherwood . | |
| 4,047,942 | 9/1977 | Clark et al. | 75/27 |
| 4,169,722 | 10/1979 | Fletcher . | |
| 4,396,422 | 8/1983 | Matsuno et al. . | |

FOREIGN PATENT DOCUMENTS

| | | | |
|---|---|---|---|
| 7976 | 3/1972 | Japan | 75/27 |

*Primary Examiner*—Melvyn J. Andrews

*Attorney, Agent, or Firm*—Orrin M. Haugen; Thomas J. Nikolai; Frederick W. Niebuhr

[57] ABSTRACT

A method and apparatus for the continuous direct reduction of iron ore concentrates utilizing metallic aluminum as a reductant material. The reactant mixture is ignited, and the reaction is permitted to proceed within the confines of a refractory lined vessel, with the exothermic heat of reaction being utilized to maintain superposed layers within the vessel, including a bottommost layer of molten metallic iron, an intermediate layer of molten slag, and an upper layer of active semi-molten reactant, with suitable means for tapping of molten slag and metal products.

3 Claims, 1 Drawing Figure

REDUCTION OF IRON ORE CONCENTRATES WITH MAGNESIUM OR ALUMINUM

BACKGROUND OF THE INVENTION

The present invention relates generally to a method for reduction of iron ore concentrates into high purity elemental iron, and more specifically to an apparatus and method for direct reduction of iron ore concentrates utilizing metallic aluminum as a reductant material. It has been known that oxidation-reduction reactions may be undertaken utilizing elemental metals selected from differing electromotive activity. In this manner, therefore, direct reduction of certain ores, particularly iron ore concentrates, may be undertaken through oxidation-reduction reactions including iron compounds and metallic aluminum.

The method and apparatus of the present invention produces iron of high purity from iron ore concentrates. The method is self-generating, and in view of the exothermic nature of the reaction, external fuel is not required. Normally, within a confined vessel, reaction temperatures exceed 5000° F. In accordance with the reaction, the immediate products are molten aluminum oxide—silicon oxide refractory slag along with molten iron of high purity. The high purity iron is withdrawn from the reactant vessel along or through a tapping port disposed at a first and lower axial disposition or location, and molten slag is tapped from a port disposed above the metal tapping port.

Iron recovery typically exceeds 99% for stoichiometric mixtures, with analysis of the iron product showing less than 0.01 weight percent carbon and less than 0.005 weight percent of all other individual elements normally analzyed spectrographically. These individual elements normally include manganese, phosphorus, sulfur, silicon, nickel, chromium, molybdenum, copper, aluminum, titanium and magnesium.

The basic stoichiometric equations for the direct reduction of common iron oxides found in iron ore concentrates are as follows:

$$8Al(s)+3Fe_3O_4(s)\rightarrow 9Fe(l)+4Al_2O_3(l)$$

or $$2Al(s)+Fe_2O_3(s)\rightarrow 2Fe(l)+Al_2O_3(l)$$

SUMMARY OF THE INVENTION

In accordance with the present invention, a direct reduction of iron ore concentrate is undertaken by initially preparing a reactant mixture of particular solids comprising iron ore concentrate and a reductant metallic element having an electromotive activity substantially greater than iron. Such a reductant material is preferably metallic aluminum. The reactant mixture is introduced into a reduction reaction zone contained within a refractory lined reactant vessel containing an atmosphere with oxygen therein. The reactant mixture is heated to an elevated temperature within the reactant zone until the mixture is ignited. The reactant vessel is arranged to have a holding zone along the lower portion thereof so as to create a series of layers of molten materials at elevations below the upper reduction zone so as to retain layers of molten iron and molten slag therein. Means are provided to tap molten reactant product from the refractory vessel along generally vertically disposed walls thereof through plural ports arranged in vertically spaced apart locations. One of the ports is disposed at an elevation for withdrawing molten iron, and with at least one other port being arranged for withdrawing molten slag. The withdrawal rates from the vessel are such that the arrangement provides for continuously maintaining the superimposed molten layers within the reactant vessel.

In addition to the layers of molten slag and molten metal, a semi-molten zone exists above the molten slag layer in which a bulk of the reaction occurs. It is within this zone that reactant particles are suspended, with the reduced reactant particles passing through the molten slag layer and reaching and becoming a portion of the molten metallic iron zone.

Therefore, it is a primary object of the present invention to provide an improved technique for the continuous direct reduction of iron ore concentrates utilizing aluminum as a reductant, and utilizing a reactor vessel which permits continuous addition along with continuous tapping of molten iron and slag therefrom.

It is a further object of the present invention to provide an improved method and apparatus for the direct reduction of iron ore concentrates on a continuous basis, with a reactor vessel being provided having a feed system for accommodating variable feed rates, and further providing temperature monitoring devices to maintain reactor conditions and operations within a known safe range.

It is yet a further object of the present invention to provide an improved method and apparatus for the direct reduction of iron ore concentrates on a continuous basis, wherein a reactor vessel is provided which requires no external fuel or heat during the reduction process, and with the process being designed to utilize commercially available iron ore concentrates and metallic aluminum.

Other and further objects of the present invention will become apparent to those skilled in the art upon a study of the following specification, appended claims, and accompanying drawings.

IN THE DRAWING

FIG. 1 is a vertical sectional view taken generally through the diameter of a typical reactant vessel for undertaking the direct reduction process of iron ore concentrate in accordance with the process of the present invention.

DESCRIPTION OF THE PREFERRED EMBODIMENT

Figure 1:
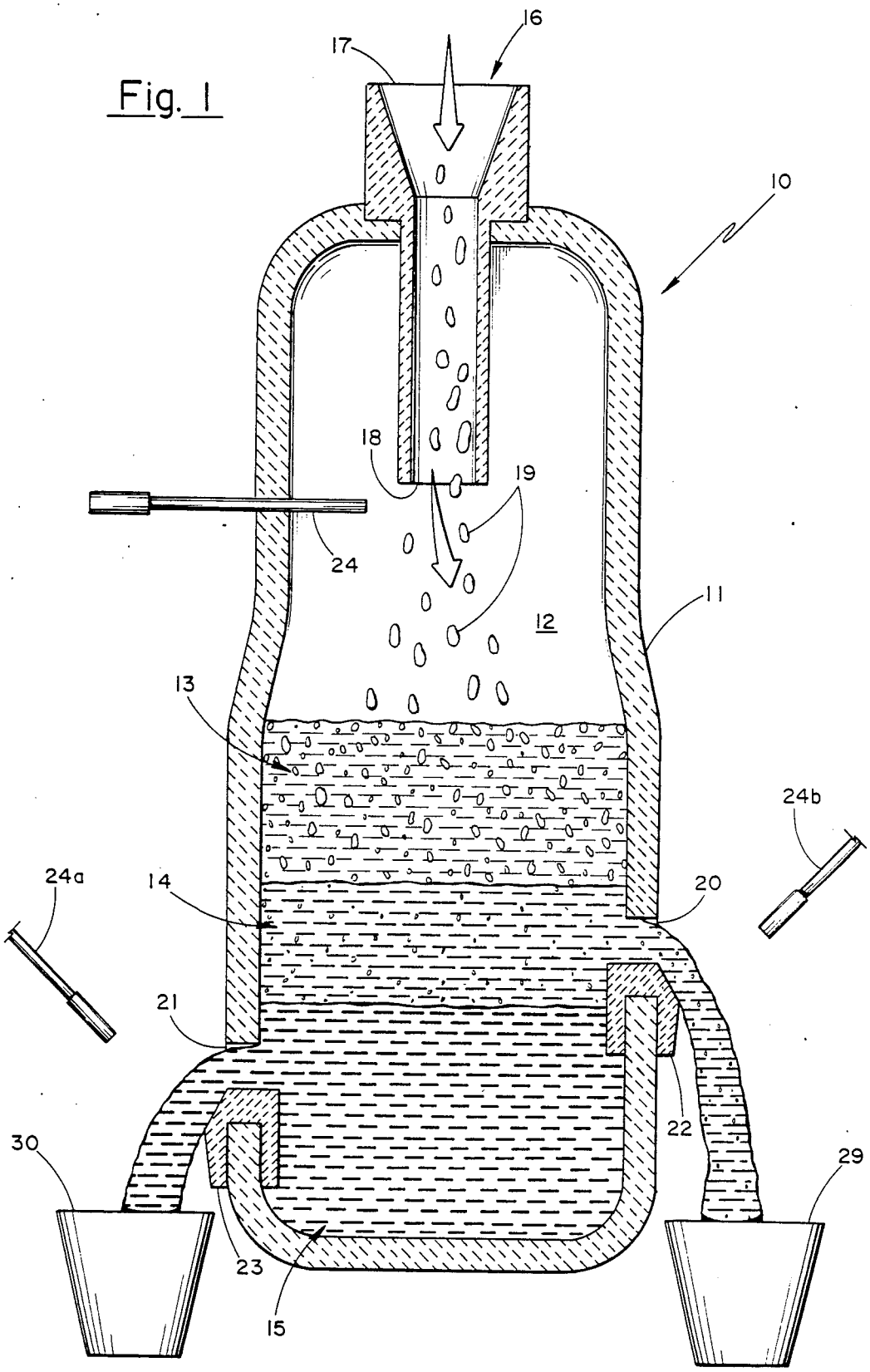

In accordance with the preferred embodiment of the present invention, and with particular attention being directed to FIG. 1 of the drawing, the direct reduction process for iron ore concentrate in accordance with the present invention may be carried out in the reactor vessel generally designated 10, with the reactant vessel including an enclosure 11 of a refractory shell, enclosing an upper reactant zone 12. The enclosure 11 is arranged along an elongated axis, and in addition to the zone 12 includes a semi-molten reactant sone 13, a molten slag retaining zone 14, and a molten iron product zone 15.

In order to introduce the reactant mixture into the vessel, an introducing tube generally designated 16 is provided having an opening or port 17 through which particulate solid material is permitted to flow, as indicated, through port 18. The particulate solids are indicated as at 19-19 within the confines of the vessel.

Upon reaching the enclosure, and being subjected to temperatures in the area of 4000°-6000° F., a semi-molten reaction mass is formed, such as is illustrated within zone 13, and the reduction reaction occurs. The reaction products descend by gravity through the zone 13, and into the molten slag zone as at 14. A port is formed within enclosure 11 as at 20 for the continuous withdrawal or tapping of molten slag.

Molten slag is permitted to be withdrawn through port 20, under the control of vertically adjustable refractory gate 22. At a location beneath the molten slag zone, the molten iron is contained within zone 15, with port 21 being utilized to extract, withdraw, or otherwise tap molten iron from the enclosure 11. Various tapping ports may be utilized as is known to those skilled in the art.

In order to tap or discharge materials from the enclosure 11, vertically spaced-apart tapping ports are provided. The elevation of the individual tapping ports will, of course, determine the resident-time of the reactants within the vessel, and will, to a certain extent, determine the properties and/or composition of the materials being discharged from the enclosure. In general, a longer resident-time will increase the purity of the molten iron being removed from enclosure 11.

Upon being discharged from the enclosure 11, the slag is retained within collection vessel 29, and molten iron is collected within vessel 30.

In order to control and/or monitor the reaction conditions, thermocouple 24 is disposed within the upper reaction zone. Temperature sensing devices for the molten products are as shown at 24A and 24B. Temperature sensors 24A and 24B may be, for convenience, radiant temperature sensing devices of the type well-known in the art.

In order to further discuss the reaction, the following example is given:

EXAMPLE I

A reactant mixture is prepared utilizing a mixture of iron ore concentrate, the mixture being finely divided particulate solids. Preferably, such a material mineralogically known as magnetite ($Fe_2O_4$) is utilized, consisting essentially of ferrous iron although hematite ($Fe_2O_3$) may be alternatively used and is essentially ferric iron. A stoichiometric addition of aluminum is added, with the following weights according to the following equation for magnetite:

| $8\ Al\ (s) + 3\ Fe_3O_4\ (s) \rightarrow 9\ Fe\ (l) + 4\ Al_2O_3\ (l)$ | | | |
|---|---|---|---|
| 216 grams | 696 grams | 504 grams | 408 grams |
| 23.7% | 76.3% | 55.3% | 44.7% |
| Total Reactants = 912 grams | | Total Products = 912 grams | |

In the process, the percent aluminum addition is typically less than stoichiometric and may vary depending on process and product quality requirements.

The slag may be cast into various desired configurations for refractory and/or wear requirements.

In the process, it is generally desirable to extract reactant product at the same rate as the addition rate, and with this being undertaken continuously. Also, it is important to include a slag layer of substantial level or height so as to permit the molten iron particles to drift under the influence of gravity through the molten slag layer. In this manner, the reaction is maintained at a controllable level, and product quality is controlled.

If desired, the feed rate may be increased, it being understood that a dispersed feed is helpful in increasing the reaction volume or area. A temperature within the molten iron zone of about 4000° F. is felt to be a practical upper limit, since this approaches the vaporization point of metallic iron.

If desired, additions of alloy elements or slagging agents may be made without additional fuel requirements.

If desired, the molten mass may be stirred by magnetic means, with magnetic stirs being, of course, known in the art.

As has been indicated, the atmosphere desired for the reaction is normally air, however other atmospheres may be employed if desired. Non-reactive inert gases may be utilized, with argon being a desirable and perferred material as a degasant and also as an aid in purification of the metallic iron product. Vacuum systems may also be employed.

If it is desired to shut down the reaction, the introduction of a reactant mixture may be terminated. The reactant mass remaining in the vessel after final tapping will solidify, and may be re-melted by introduction of reactant mixture, and with the reactant mixture being ignited by means of a propane torch or the like. Sufficient heat is normally generated to permit removal of reaction product from the vessel within a short time following the introduction of the reactant mixture and the initiation of the reaction.

We claim:

1. A continuous process for the direct reduction of iron ore concentrates to produce a product of high purity elemental iron of a purity greater than 99 percent of elemental iron comprising:

(a) preparing a reactant mixture of particulate solids comprising iron ore concentrates and a reductant metallic element having an electromotive activity substantially greater than iron and selected from the group consisting of magnesium and aluminum;

(b) substantially continuously introducing said reactant mixture at a predetermined rate into the reduction-reaction zone of an elongated generally vertically disposed refractory lined reactant vessel and wherein said reaction vessel includes a reduction reaction zone adjacent the upper end portion thereof and a molten iron retaining and removal zone adjacent the lower portion thereof;

(c) heating said reactant mixture to an elevated temperature within said reduction reaction zone through oxidation of said reductant metallic element and reduction of said iron ore concentrates within said reduction zone until said reactant mixture becomes ignited and becomes at least semi-molten;

(d) creating a series of layers of molten material within said reactant vessel at an elevation below said reduction reaction zone and including a base layer of molten highly purity elemental iron, a superposed intermediate layer of molten slag, and an upper mixed layer of said semi-molten reactant mixture; and (e) substantially continuously tapping reactant product from said reaction vessel along a generally vertically disposed wall thereof through a plurality of ports arranged at vertically spaced apart locations therealong at a rate substantially equal to said predetermined rate so as to maintain the molten level within said reactant vessel substantially constant, and with at least one of said ports being disposed at an elevation for withdrawing molten high purity elemental iron product from said metallic product retaining zone, and with at least one other of said ports withdrawing molten slag from said molten product retaining zone, with the withdrawal rates for said molten slag and said molten high purity elemental iron product each being selected to provide for the continuous maintenance of said layers of semi-molten reactant, molten slag, and molten high purity elemental iron.

2. The process as defined in claim 1 being particularly characterized in that said reactant mixture is typically less than stoichiometric of said reductant metallic element.

3. The process as defined in claim 1 being particularly characterized in that said reductant metallic element is aluminum.

* * * * *